US012448720B1

(12) United States Patent
Scionti et al.

(10) Patent No.: US 12,448,720 B1
(45) Date of Patent: Oct. 21, 2025

(54) DISPENSING SYSTEM AND METHOD OF USE

(71) Applicants: Guiseppe S. Scionti, Port St. Lucie, FL (US); Jayson Bono, Port St. Lucie, FL (US)

(72) Inventors: Guiseppe S. Scionti, Port St. Lucie, FL (US); Jayson Bono, Port St. Lucie, FL (US)

(73) Assignee: Guiseppe S. Scionti, Port St. Lucie, FL (US)

( * ) Notice: Subject to any disclaimer, the term of this patent is extended or adjusted under 35 U.S.C. 154(b) by 0 days.

(21) Appl. No.: 18/955,562

(22) Filed: Nov. 21, 2024

(51) Int. Cl.
*D06F 39/02* (2006.01)

(52) U.S. Cl.
CPC ..... *D06F 39/022* (2013.01)

(58) Field of Classification Search
CPC ..... D06F 39/022
USPC ..... 68/207
See application file for complete search history.

(56) References Cited

U.S. PATENT DOCUMENTS

| | | | | |
|---|---|---|---|---|
| 2,707,068 | A | 4/1955 | Williamson | |
| 4,747,523 | A * | 5/1988 | Dobbs | B05B 11/1011 239/526 |
| 5,207,080 | A | 5/1993 | Reinhard | |
| 5,870,906 | A | 2/1999 | Denisar | |
| 7,036,175 | B2 | 5/2006 | Sears et al. | |
| 8,931,310 | B2 | 1/2015 | Risen et al. | |
| 9,181,650 | B2 | 11/2015 | D'Andrea et al. | |
| 2006/0086156 | A1 | 4/2006 | Taylor | |
| 2010/0139328 | A1 | 6/2010 | Favaro | |
| 2013/0042652 | A1 | 2/2013 | Brueckner et al. | |

FOREIGN PATENT DOCUMENTS

| | | | |
|---|---|---|---|
| AU | 78393/91 | A | 1/1992 |
| CN | 207267941 | U | 4/2018 |
| CN | 216809289 | U | 6/2022 |
| GB | 2113255 | A | 8/1983 |

OTHER PUBLICATIONS

CN207267941U—machine translation (Year: 2018).*
"Washing Machine Laundry Detergent Dispensing" https://www.home-tech.com/8350/washing-machine-laundry-detergent-dispensing/.
"Sudspenser—The laundry detergent dispenser" https://www.sudspenser.com/#/.

* cited by examiner

*Primary Examiner* — Tinsae B Ayalew
(74) *Attorney, Agent, or Firm* — Akerman LLP

(57) ABSTRACT

A fluid dispensing system may include a body having an interior space, an inlet, and an outlet. The interior space may include a fluid holding area in fluid communication with the inlet and outlet. A plunger is translatable within the interior space between a compressed position and a decompressed position. A biasing member operably couples to the plunger to bias the plunger in a first direction. A trigger operably couples to the plunger. Actuation of the trigger causes the plunger to translate in a second direction, counter to the bias provided by the biasing member. The fluid dispensing system may be used to dispense liquid laundry detergent.

10 Claims, 5 Drawing Sheets

DISPENSING SYSTEM AND METHOD OF USE

SUMMARY

In one aspect, a laundry detergent dispensing system includes a body having an interior space, an inlet, and an outlet. The interior space may include a fluid holding area in fluid communication with the inlet and outlet. A plunger is translatable within the interior space between a compressed position and a decompressed position. A biasing member operably couples to the plunger to bias the plunger in a first direction. A trigger operably couples to the plunger. Actuation of the trigger causes the plunger to translate in a second direction, counter to the bias provided by the biasing member.

In one example, translation of the plunger in the second direction translates the plunger toward the compressed position that at least partially loads the biasing member and translates a face of the plunger relative to the fluid holding region such that an available volume in the fluid holding region is reduced.

In a further example, translation of the plunger in the first direction translates the plunger toward the decompressed position that at least partially unloads the biasing member and translates the face of the plunger relative to the fluid holding region such that an available volume in the fluid holding region is increased.

In a further example, a travel distance of the face of the plunger within the fluid holding region corresponds to the measured quantity of the fluid dispensed when the trigger is actuated.

In another example, the trigger comprises a first end that pivotally couples to a handle portion that extends from the body and a second end that couples to the plunger. The second end includes a slot through which a pin that extends from the plunger is received. Actuation of the trigger may cause the trigger to pivot from the first end while moving the pin to cause the plunger to translate in the second direction as the pin moves through the slot.

In a further example, the plunger may include a retaining bracket from which the pin extends. The biasing member may couple to the plunger via the retaining bracket.

In one example, when liquid detergent is held within the fluid holding region, actuation of the trigger is configured to causes a measured volume of the liquid detergent to be dispensed from the fluid holding region via the outlet. When a fluid reservoir containing the liquid detergent is fluidically coupled to the inlet, subsequent release of the trigger released the bias of the bias member to translate the plunger in the first direction toward a decompressed position that increases an available volume and decreases pressure in the fluid holding region configured to cause the liquid detergent contained within the fluid reservoir to be drawn into the fluid holding region through the inlet.

In a further example, the trigger includes a first end that pivotally couples to the handle portion and a second end that couples to the plunger. The second end includes a slot through which a pin that extends from the plunger is received. Actuation of the trigger causes the trigger to pivot from the first end while moving the pin to cause the plunger to translate in the second direction as the pin moves through the slot.

In one example, the biasing member is disposed within the interior space of the body.

In one example, the inlet and the outlet each comprise a check valve.

In another aspect a method of dispensing laundry detergent includes using a dispensing system comprising a body, a plunger, a biasing member, and a trigger. The body may include an interior space, an inlet, and an outlet, the interior space including a fluid holding area in fluid communication with the inlet and outlet. The plunger may be translatable within the interior space between a compressed position and a decompressed position. The biasing member may operably couple to the plunger to bias the plunger in a first direction. The trigger may operably couple to the plunger. Actuation of the trigger may cause the plunger to translate in a second direction, counter to the bias provided by the biasing member. Using the dispensing system may include actuating the trigger to cause liquid laundry detergent held within the fluid holding region to be dispensed from the outlet, and releasing the trigger to cause liquid laundry detergent to be drawn into the fluid holding region from a fluid reservoir fluidically coupled to the inlet.

In one example, the method includes priming the fluid holding region including repeatedly actuating and releasing the trigger until air within the fluid holding region is expelled and replaced with the liquid laundry detergent from the fluid reservoir.

In one example, actuating the trigger translates the plunger in the second direction corresponding to translation of the plunger toward the compressed position that at least partially loads the biasing member and translates a face of the plunger relative to the fluid holding region such that an available volume in the fluid holding region is reduced.

In a further example, releasing the trigger translates the plunger in the first direction corresponding to translation of the plunger toward the decompressed position that at least partially unloads the biasing member and translates the face of the plunger relative to the fluid holding region such that an available volume in the fluid holding region is increased.

In one example, the trigger comprises a first end that pivotally couples to the handle portion and a second end that couples to the plunger. The second end may include a slot through which a pin that extends from the plunger is received. Actuating the trigger may cause the trigger to pivot from the first end while moving the pin to cause the plunger to translate in the second direction as the pin moves through the slot.

In a further example, the plunger comprises a retaining bracket. The biasing member may couple to the plunger via the retaining bracket, and the pin extends from the retaining bracket.

In one example, actuating the trigger causes a measured volume of the liquid detergent to be dispensed from the fluid holding region via the outlet. Releasing the trigger may release the bias of the bias member to translate the plunger in the first direction toward the decompressed position that increases an available volume and decreases pressure in the fluid holding region to cause the liquid detergent contained within the fluid reservoir to be drawn into the fluid holding region through the inlet.

In a further example, the trigger comprises a first end that is pivotally coupled to a handle portion that extends from the body and a second end that couples to the plunger. The second end includes a slot through which a pin that extends from the plunger is received. Actuating the trigger causes the trigger to pivot from the first end while moving the pin to cause the plunger to translate in the second direction as the pin moves through the slot.

In one example, the biasing member is disposed within the interior space of the body.

In one example, the inlet and the outlet each comprise a check valve.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DETAILED DESCRIPTION

Figure 1:
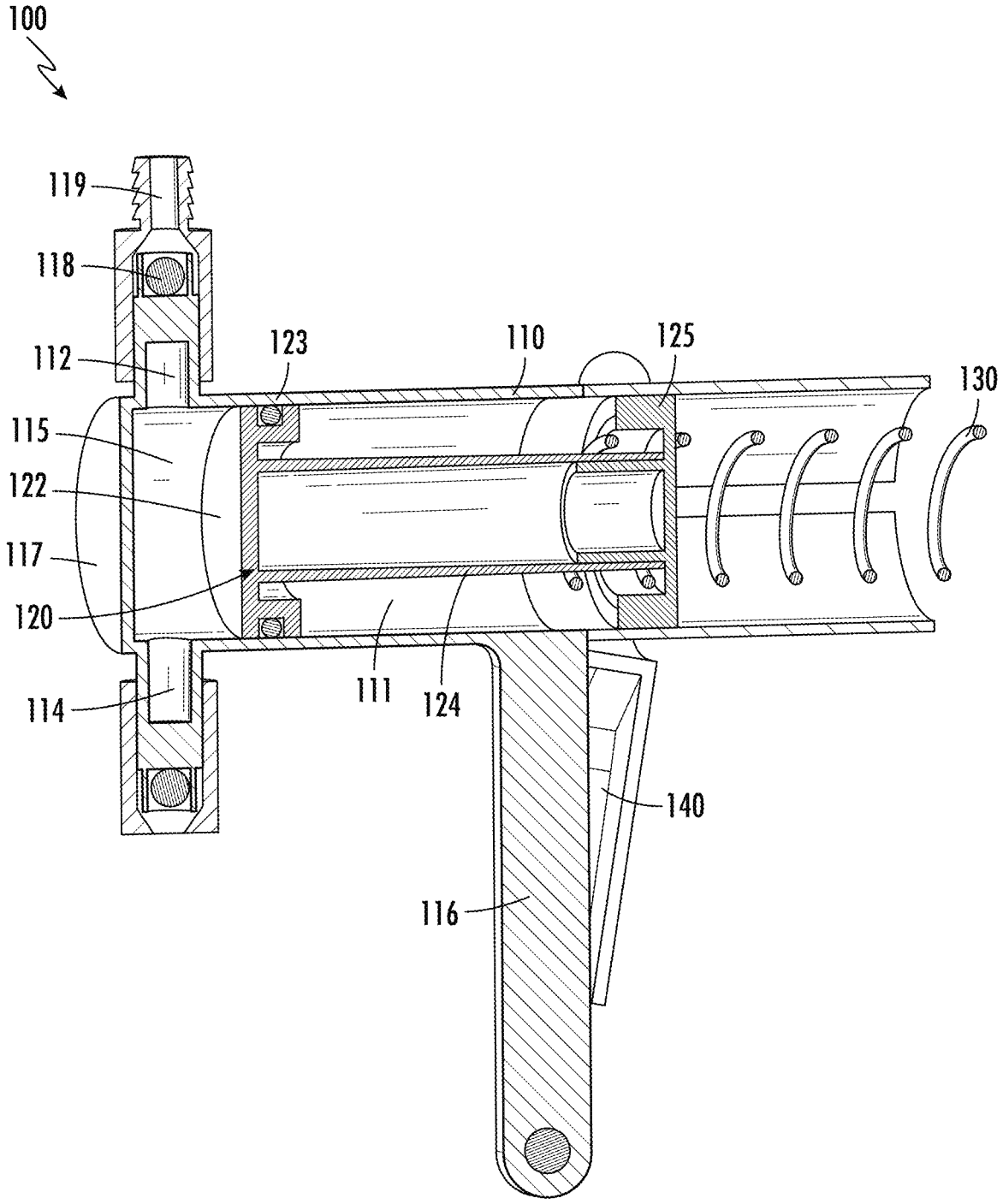
FIG. 1 illustrates a dispensing system according to various embodiments described herein.

The present description describes dispensing systems and related methods. In various embodiments, the fluid despising system may be configured with a pump mechanism that is easy to use an operated without an external power source. The dispensing system may be configured to dispenses precise amounts of fluid, minimizing waste. The dispensing system may be provided in various ergonomic designs configured for repeated operation with minimal fatigue to the user. The dispensing system may be beneficially employed to dispense liquid laundry detergents by pulling the detergent from a fluid reservoir such as a commercial laundry detergent bottle.

FIGS. 1-4 illustrate a dispensing system 100 according to various embodiments. The dispensing system 100 may include a body 110, a plunger 120, a biasing member 130 to provide bias, and a trigger 140. The plunger 120 is translatable within an interior space 111 of the body 110 to pull fluid into and expel fluid from a fluid holding region 115 within the interior space 111. The trigger 140 and biasing member 130 are operable to translate the plunger 120. The trigger 140 may operate counter to the bias to translate the plunger 120 toward wall 117 and the biasing member 130 provides the bias to translate the plunger 120 away from wall 117, e.g., when the trigger 140 is released.

The body 110 may include an interior space 111 comprising a fluid holding region 115 for holding fluid, such as liquid detergent, and subsequently dispensing the fluid via operation of the dispensing system 100. The plunger 120 may be translatable within the interior space 111 to modify a volume, pressure, or both within the fluid holding region 115. The interior space 111 extends along a longitudinal axis and the plunger 120 is translatable therethrough to modify the volume and pressure of the fluid holding region 115. The body 110 includes a tubular cylindrical cross-section shape, however, other body shapes.

The body 110 may be constructed of suitable material such as plastics, metals, or a combination thereof. In some embodiments, the body 110 may be transparent or semi-transparent, allowing the plunger 120 and the fluid passing through the fluid dispensing system 100 to be visible from the exterior of the fluid dispensing system 100. In an above or another embodiment, the exterior surface of the body 110 may further include measurement indices for visualizing and measuring the amount of fluid dispensed by the dispensing system 100. The body may allowing the plunger 120 and the fluid passing through the dispensing system 100 to be visible from the exterior of the dispensing system 100. may extend along a longitudinal axis and define an interior space 111 for retaining fluid.

The body 110 may further include an inlet 112 and an outlet 114. The inlet 112 and outlet 114 may be in fluid communication with the fluid holding region 115 of the interior space 111. As noted above and described in more detail below, the available volume of the fluid holding region 115 changes with translation of the plunger 120. The inlet 112 and outlet 114 are in fluid communication with the fluid holding region 115 to communicate fluid therebetween. The inlet 112 and outlet 114 may be disposed on the exterior of the body 110. In the embodiment shown in FIGS. 1 and 2, the inlet 112 and the outlet 114 are generally be disposed opposite one another on the distal end of the body 110. The location of the inlet 112, outlet 114, or both may be modified. However the inlet 112, outlet 114, or both may be disposed on an end wall 117 of the body 110 or at other locations along the body 110. For example, in the embodiment shown in FIGS. 3 and 4, the outlet 114 is disposed on end wall 117 of the body 110 and the inlet 112 is disposed on the exterior of the body 110 towards the distal end of the body 110 to the outlet 114. In some embodiments, the inlet 112 and outlet 114 may be integrally formed with the body 110. In other embodiments, the inlet 112 and the outlet 114 may be separably connected to the body 110 by a mating threaded connection.

In some embodiments, one or both of the inlet 112 or the outlet 114 may include a check valve 118. Various check valve configurations may be used such as duckbill, ball, butterfly, or other suitable check valve. In some embodiments, the inlet 112, outlet 114, or both may include a connector for coupling to a hose to thereto. For example, a hose may couple between the inlet and a fluid reservoir, such as a bottle of liquid laundry detergent, and another hose may couple to the outlet at a first end and have a second end positioned with respect to a washing machine to supply the output fluid therein. In the embodiment shown in FIG. 1, the inlet 112 includes a connector 119 for connecting to fluid reservoir containing a fluid detergent via a hose (not shown). The connector 119 comprises a barbed coupling for engaging an inner diameter of the hose via a friction fit. Other connection fittings may be used, e.g., threaded, couplers, compression fittings, or the like.

As introduced above, a plunger 120 may be operable to translate within the interior space 111 of the body 110 to modify the volume and/or pressure of the fluid holding region. The plunger 120 may translate within the interior space 111 in a sealed relationship therewith, e.g., via a gasket 123, and include a face 122 in fluid communication with the fluid holding region 115. For example, the plunger 120 may be translatable between a compressed position wherein movement of the plunger 120 to the compressed position has caused fluid in the fluid holding region 115 to be expelled, and a decompressed position wherein movement of the plunger 120 to the compressed position has caused fluid to be pulled into the fluid holding region 115. As explained in more detail below, in some embodiments, the plunger 120 may be translatable to various intermediate positions and/or the positions of the plunger 120 may be modified to change the available volume and/or pressure within the fluid holding region 115 between compressed, decompressed, and/or intermediate positions of the plunger 120. The plunger face 122 may be positioned to contact fluid, e.g., liquid detergent, within the fluid holding region 115, however, in other embodiments, the plunger 120 may be operable to modify pressure within the fluid holding region 115 without contacting fluid within the fluid holding region 115.

In FIGS. 1-4, the plunger 120 is shown in a decompressed position disposed within the interior space 111 of the body 110 and translatable therein. However, in some embodiments, the decompressed position may be operable as a compressed position wherein liquid detergent remains within the fluid holding region 115 after the plunger 120 translates to the compressed position. Thus, the positions of the plunger 120 may be considered relative and with respect to the particular configuration such that translation of the plunger toward the decompressed position may increase volume and/or reduce pressure within the fluid holding region 115 and causes fluid to be pulled into the fluid holding region 115 of the interior space 111 from a fluid reservoir through the inlet 112, and translation of the plunger 120 toward the compressed position may decrease volume and/or increase pressure within the fluid holding region 115 causing fluid within the fluid holding region to be expelled from fluid holding region 115 through the outlet 114.

The plunger 120 may be operatively coupled to the bias of the biasing member 130 such that the bias translates the plunger 120 toward the compressed position or the decompressed position. The plunger 120 may include a coupling portion 124 for operatively coupling to the bias of the biasing member 130. The coupling may be direct or indirect with respect to the biasing member 130. In the embodiment shown in FIG. 1, the coupling portion 124 connects to the biasing member 130 via a retaining bracket 125 configured to connect to the biasing member 130. In some embodiments, the coupling portion 124, and hence the plunger 120, includes the retaining bracket 125. As described in more detail below, the trigger may operatively couple to the plunger 120 to cause translation of the plunger 120 toward the compressed position or decompressed position. The coupling may be provided at the coupling portion 124.

A proximal portion of the plunger 120 may include the face 122 and gasket 123, which connect to a distal portion of the plunger 120 comprising the coupling portion 124. The proximal and distal portions may be integral or separably connected. The coupling portion 124 may be dimensioned relative to the location of one or more of the bias member 130, handle 116, trigger 140, plunger face 115, or fluid holding region 115 to provide optimal operation. For example, the coupling portion 124 may include an extension that connects the plunger face 115 to the location of the bias, e.g., a retaining bracket 125, biasing member.

As introduced above, the trigger 140 may operatively couple to the plunger 120 wherein operation of the trigger 140 causes or allows the plunger 120 to translate. The trigger 140 may directly or indirectly couple to the plunger 120. The trigger 140 may pivotably or slidably couple to the plunger 120 such that movement, e.g., actuation, of the trigger 140 translates the plunger 120. In some embodiments, the trigger 140 may couple to the plunger 120 via gearing.

Figure 3:
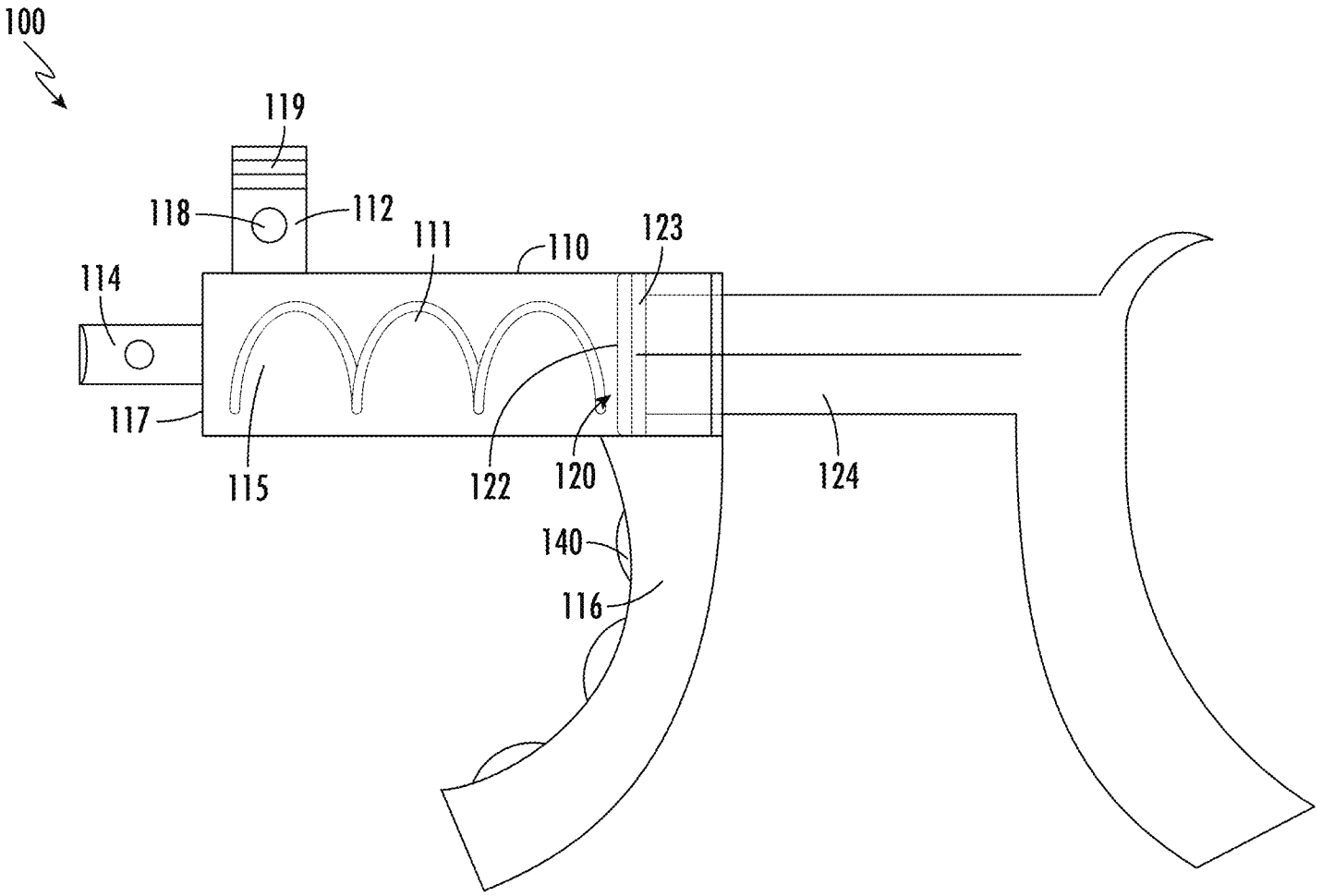
FIG. 3 illustrates a dispensing system according to various embodiments described herein.

In some embodiments, the plunger 120, biasing member 130, and trigger 140 directly or indirectly couple. In FIG. 1, the biasing member 130 engages the plunger 120 at the retaining bracket 125. In FIG. 3, the biasing member 130 is disposed in the interior space 111 of the body 110 between the wall 117 and the plunger face 122. Various biasing members may be employed. In both embodiments, the biasing member 130 comprises a spring. In some embodiments, the biasing member 130 may further include an adjustment element for adjusting the bias of the biasing member 130 as describe further below.

Figure 2:
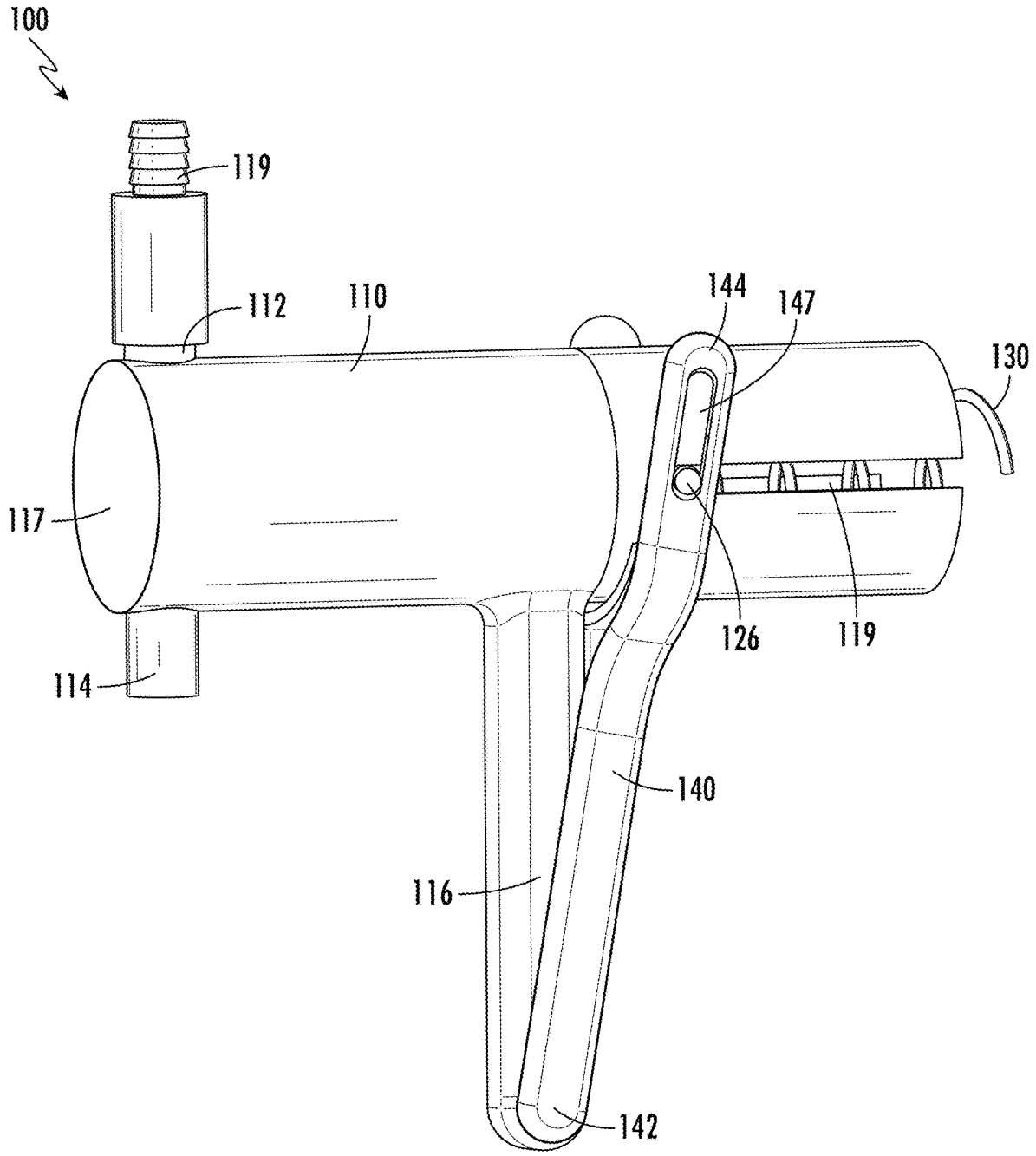
FIG. 2 illustrates a cross-sectional view of a dispensing system according to various embodiments described herein.

In FIGS. 1 and 2, the trigger 140 operably couples to the handle portion 116, plunger 120 and biasing member 130. The trigger 140 pivotably, slidably, or otherwise couple to the plunger 120, biasing member 130, or both such that operation of the trigger 140 causes translation of the plunger 120. In the illustrated embodiment, the trigger 140 has a first end 142 that is pivotally connected to the handle portion 116 of the body 110 and a second end 144 that is coupled to the plunger 120 via the retaining bracket 125. One or more slots 147 are provided that receive one or more pins 126 that extend from the retaining bracket 125 of the plunger 120. Actuation of the trigger 140 causes the trigger to pivot from the first end 142 to move the pin 126 through a slot 119 in the body 110 toward the handle portion 116. As the pin 126 moves through slot 119, the pin 126 also moves through slot 147 of the trigger 140. The trigger movement causes the plunger 120 to translate within the interior space 111 of the body 110 from a decompressed position to a compressed position (FIG. 1) wherein the fluid volume within the fluid holding region 115 in the interior space 111 is reduced relative to the decompressed position causing fluid to be expelled from the fluid holding region 115. Thus, in the decompressed position the fluid volume within the fluid holding region 115 may retain a greater volume of fluid and in the compressed position less fluid may be retained actuation of the trigger 140 also at least partially loads the biasing member 130. Release of the trigger 140 allows the bias provided by the bias member 130 to translate the plunger 120 to a decompressed position to pull fluid into the fluid holding region 115 via the inlet 112, reloading the fluid holding region 115 with fluid, e.g., liquid detergent. As the plunger 120 is translated to the decompressed position, pin 126 moves through slot 119. Pin 126 also moves through slot 147 to pivot the trigger 140, returning it to its pre-actuated position. Accordingly, release of the trigger 140 may cause translation of the plunger 120 toward a decompressed position that causes fluid to be pulled through the inlet 112 into the increasing available fluid volume of the fluid holding region 115 and actuation of the trigger 140 may drive translation of the plunger 120 toward the compressed position to cause fluid to be expelled from the decreasing volume of the fluid holding region 115 through the outlet 114. In some embodiments, trigger actuation, biasing, and translation of the plunger 120 relationships may be modified. For example, the bias member 130 may be loaded by a lever or knob separate of the trigger 140. In another example, operation of the trigger 140 loads the bias member 130 and a separate trigger or a switch that changes the action of the trigger 140 from a loading operation to a release of bias operation, e.g., via gears, pawls, or both may be employed. In one example, the switch operates such that loading and release of bias are controllable by degree of compression of the trigger 140, e.g., full compression releases bias and partial compression loads bias.

Figure 4:
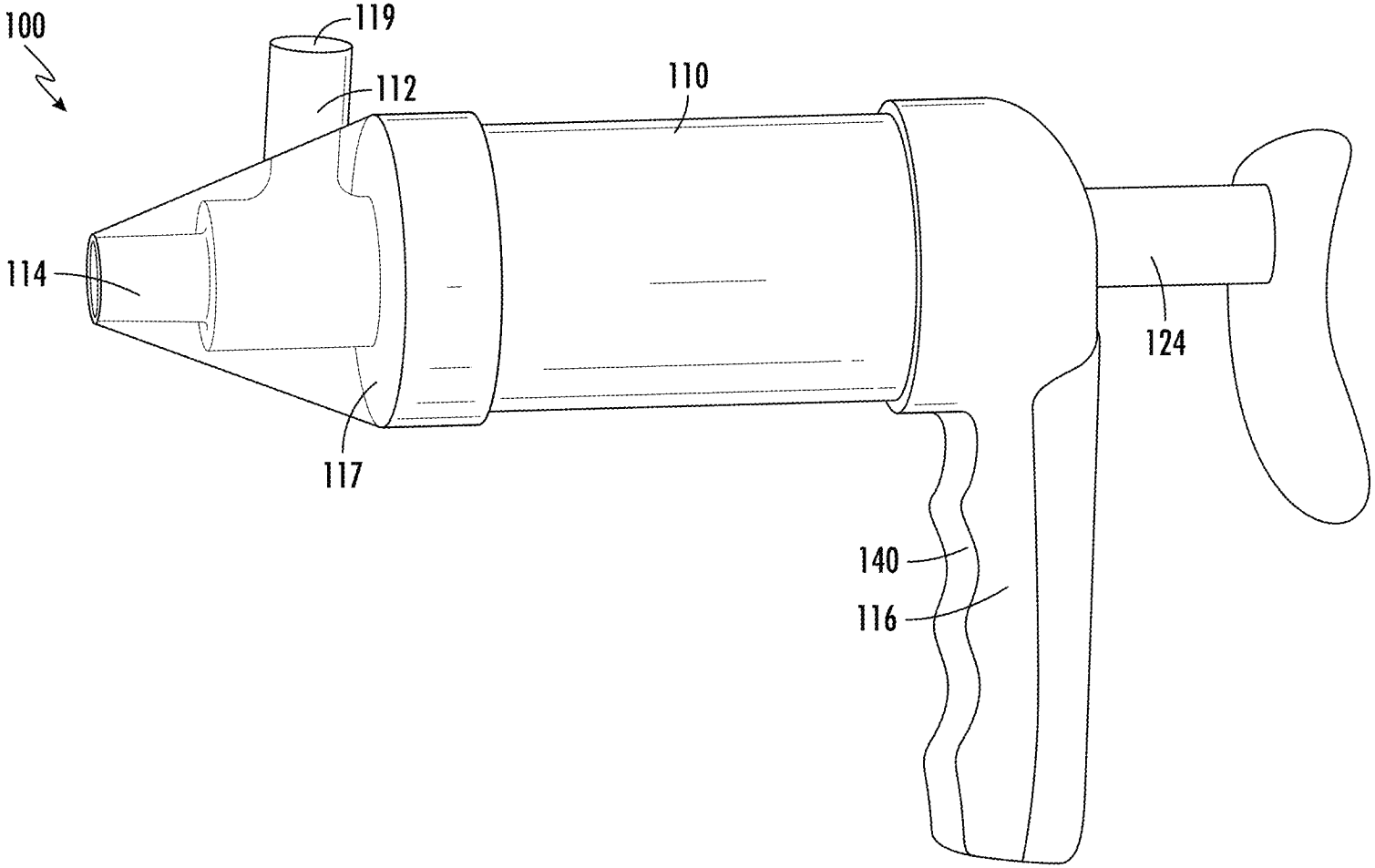
FIG. 4 illustrates a cross-sectional view of a dispensing system according to various embodiments described herein.

In in FIGS. 3 and 4, the trigger 140 pivotably, slidably, or otherwise couples to the operation of the plunger 120 such that operation of the trigger 140 causes translation of the plunger 120. Actuation of the trigger 140 causes the plunger 120 to translate within the interior space 111 of the body 110 from a decompressed position (FIG. 3) to a compressed position wherein the fluid volume within the fluid holding region 115 in the interior space 111 is reduced relative to the decompressed position causing fluid to be expelled from the fluid holding region 115. Thus, in the decompressed position the fluid volume within the fluid holding region 115 may retain a greater volume of fluid and in the compressed position less fluid may be retained. Accordingly, release of the trigger 140 may cause translation of the plunger 120 toward a decompressed position that causes fluid to be pulled through the inlet 112 into the increasing available fluid volume of the fluid holding region 115 and actuation of the trigger 140 may drive translation of the plunger 120 toward the compressed position to cause fluid to be expelled from the decreasing volume of the fluid holding region 115 through the outlet 114. In some embodiments, a biasing member 130 may be disposed within the interior space 111 of the body 110 between the wall 117 and the plunger face 122 or within a sleeve therealong. Actuation of the trigger 140 may also cause a load to be applied to the biasing member 130 when the plunger 120 is in the compressed position. Releasing the trigger 130 may cause the biasing member 130 to release the applied load, causing the plunger 120 to return to the decompressed position. In other embodiments, no biasing member is provided and the movement of the trigger 140 between the decompressed position and the compressed position causing translation of the plunger 120 is manually controlled by the user.

The dispensing system 100 may be configured to dispense fluid in a measured quantity with each actuation of the trigger 140. The amount of fluid dispensed with each actuation of the trigger 140 may be defined by one or more parameters such as overall dimensions of the body 110 and travel distance of the plunger face 122. The travel distance of the plunger face 122 may be defined as the distance traveled by the plunger face 122 during translation of the plunger 120, e.g., between compressed and decompressed positions.

In some embodiments, the travel distance of the plunger face 122 may be adjustable. For example, the dispensing system 100 may include an adjustable element (not shown) that allows for the amount of fluid dispensed by the dispensing system 100 to be adjusted or changed. The adjustable element may include a knob disposed on the body 110. The knob may engage with the biasing member 130 and the plunger 120 such that rotating the knob clockwise or counter-clockwise adjusts the travel distance of the plunger 120 within the body 110, bias force, e.g., spring tension, or both, in turn changing the amount of fluid dispensed by the dispensing system 100. In some embodiments, the knob may be rotated clockwise or counter-clockwise between a start point and an end point in a continuous manner such that the knob can be rotated to any position between the start point and the end point. Rotating the knob clockwise may increase the travel distance, which in turn increases the amount of fluid dispensed by the dispensing system 100. Rotating the knob counter-clockwise may decrease travel distance, which in turn decrease the amount of fluid dispensed by the dispensing system 100. In another embodiment, the may be rotated clockwise or counter-clockwise or a lever or knob may be translated between a number of fixed positions, each position corresponding to a different amount of fluid dispensed by the dispensing system 100.

In an operation of the embodiment of FIGS. 1 & 2, actuation of the trigger 140 may cause the plunger 120 to translate toward a compressed position. As the plunger 120 translates, the biasing member 130 may be loaded to generate potential energy stored in the biasing member 130 in the form of spring tension. As the plunger 120 translates towards the compressed position, pressure within the fluid holding region 115 may also be increased to force fluid within the fluid holding region 115 out through the outlet 114.

When the trigger 140 is released, the potential energy stored in the biasing member 130 may be released, causing the biasing member 130 to retract and, in turn, translate the plunger 120 toward a decompressed position. As the plunger 120 translates towards the decompressed position, pressure within the fluid holding region 115 may be decreased to cause fluid from a fluid reservoir coupled to the inlet 112 to be drawn into the fluid holding region 115 through the inlet 112.

In some embodiments, the dispensing system 100 may need to be primed to dispense the correct amount of fluid. To prime the dispensing system 100, the trigger 140 may be repeatedly squeezed and released until the air within the fluid holding region 115 has been expelled and replaced with fluid, e.g., liquid detergent, from the fluid reservoir.

Figure 5:
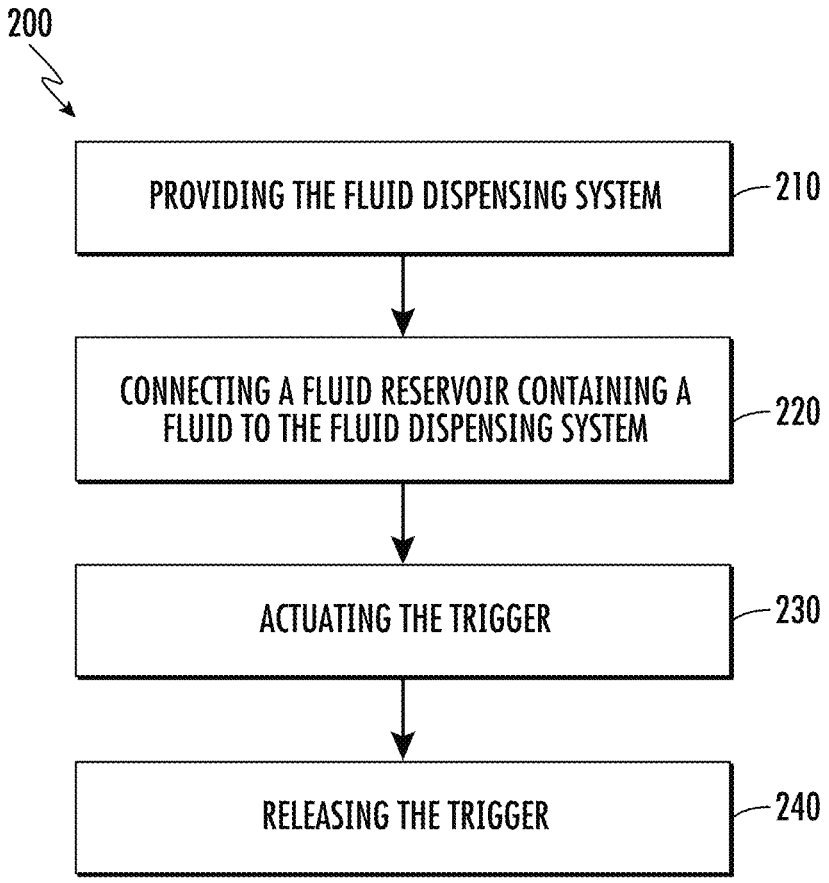
FIG. 5 illustrates a method of using the dispensing system according to various embodiments described herein.

As shown in FIG. 5, a method 200 of using the dispensing system 100 as described above may include the steps of providing the dispensing system 210, connecting a fluid reservoir containing a fluid to the dispensing system 220, actuating the trigger 230, and releasing the trigger 240.

Actuating the trigger 230 may further include translating the plunger to a compressed position and generating spring tension within the biasing member. Actuating the trigger 230 may also cause the fluid within the fluid holding region to be dispensed from the outlet.

Releasing the trigger 240 may further include releasing the spring tension generated within the biasing member and translating the plunger to a decompressed position. Releasing the trigger 240 may also cause the fluid in the fluid reservoir to be drawn into the fluid holding region of the body through the inlet.

In some embodiments, the method 200 may further include the step of priming the fluid holding region. Priming may further include repeatedly actuating and releasing the trigger until air within the fluid holding region is expelled through the outlet and replaced with the fluid from the fluid reservoir.

The dispensing system is generally described herein with respect to dispensing liquid detergent, typically for laundry applications to pull liquid laundry detergent from commercial detergent bottles and dispense the same, but those having skill in the art will appreciate upon reading the present description that the dispensing system and related methods may find applications in dispensing other fluids.

In one embodiment, a dispensing system may include a body, a plunger, and a trigger. The body may define an interior space, an inlet, and outlet, and a handle portion. The plunger may be disposed within the interior space and translatable within the interior space. The biasing member may be disposed within the interior space and engage with a distal portion of the plunger. The trigger may have a first end pivotally connected to the handle portion of the body and a second end pivotally connected the distal portion of the plunger. The body may further include an inlet and an outlet. The inlet and the outlet may be in fluid communication with each other and a fluid holding region within the body. The inlet and the outlet may each comprise a check valve. The inlet may include connector such as a barb for connecting a fluid reservoir. In some embodiments, the distal portion of the plunger may include a set of pins that pivotally connect with the second end of the trigger. In some embodiments, squeezing the trigger may cause the plunger to translate within the interior space of the body from the proximal end of the body to the distal end of the body and create tension within the biasing member. Releasing the trigger may release the tension within the biasing member, causing the plunger to translate within the interior space of the body towards the proximal end of the body. The fluid holding region may be positioned at the proximal end of the body. In some embodiments, squeezing the trigger may also cause a fluid to be dispensed in a measured quantity. Releasing the trigger may cause the fluid to be drawn into the fluid holding region through the inlet. A travel distance of the plunger within the interior space of the body may correspond to the measured quantity of the fluid dispensed when the trigger is squeezed. In some embodiments, the dispensing system may further include an adjustable element for adjusting the amount of fluid dispensed by the dispensing system by adjusting the travel distance of the plunger when the trigger is squeezed. In some embodiments, the fluid holding region may be primed with the fluid by repeatedly squeezing and releasing the trigger drawing the fluid into the fluid holding region through the inlet and expelling air from within the fluid holding region through the outlet.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or re-organizing any of the disclosed steps, components, elements, features, aspects, characteristics, limitations, and the like, of the various non-limiting and non-exhaustive embodiments described in this specification.

Various elements described herein have been described as alternatives or alternative combinations, e.g., in a lists of selectable sport challenges, entry fees, financial prizes, sport grounds, etc. It is to be appreciated that embodiments may include one, more, or all of any such elements. Thus, this description includes embodiments of all such elements independently and embodiments including such elements in all combinations.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" corresponds to "x and/or y" and refers to "x", "y", or both "x" and "y", whereas "either x or y" refers to exclusivity.

What is claimed is:

1. A method of dispensing laundry detergent, the method comprising:

using a dispensing system comprising:

a body having an interior space, an inlet, and an outlet, the interior space including a fluid holding area in fluid communication with the inlet and outlet, a plunger translatable within the interior space between a compressed position and a decompressed position, a biasing member operably coupled to the plunger to bias the plunger in a first direction, and a trigger operably coupled to the plunger, wherein actuation of the trigger causes the plunger to translate in a second direction, counter to the bias provided by the biasing member, wherein the trigger comprises a first end that pivotally couples to a handle portion and a second end that couples to the plunger;

wherein using the dispensing system comprises:

actuating the trigger to cause liquid laundry detergent held within the fluid holding region to be dispensed from the outlet; and releasing the trigger to cause liquid laundry detergent to be drawn into the fluid holding region from a fluid reservoir fluidically coupled to the inlet.

2. The method of claim 1, further comprising priming the fluid holding region, wherein priming the fluid holding region comprises repeatedly actuating and releasing the trigger until air within the fluid holding region is expelled and replaced with the liquid laundry detergent from the fluid reservoir.

3. The method of claim 1, wherein actuating the trigger translates the plunger in the second direction corresponding to translation of the plunger toward the compressed position that at least partially loads the biasing member and translates a face of the plunger relative to the fluid holding region such that an available volume in the fluid holding region is reduced.

4. The method of claim 3, wherein releasing the trigger translates the plunger in the first direction corresponding to translation of the plunger toward the decompressed position that at least partially unloads the biasing member and translates the face of the plunger relative to the fluid holding region such that an available volume in the fluid holding region is increased.

5. The method of claim 1, wherein the second end includes a slot through which a pin that extends from the plunger is received, wherein actuating the trigger causes the trigger to pivot from the first end while moving the pin to cause the plunger to translate in the second direction as the pin moves through the slot.

6. The method of claim 5, wherein the plunger comprises a retaining bracket, wherein the biasing member couples to the plunger via the retaining bracket, and wherein the pin extends from the retaining bracket.

7. The method of claim 1, wherein actuating the trigger causes a measured volume of the liquid detergent to be dispensed from the fluid holding region via the outlet, and wherein releasing the trigger releases the bias of the bias member to translate the plunger in the first direction toward the decompressed position that increases an available volume and decreases pressure in the fluid holding region to cause the liquid detergent contained within the fluid reservoir to be drawn into the fluid holding region through the inlet.

8. The method of claim 7, wherein the second end includes a slot through which a pin that extends from the plunger is received, and wherein actuating the trigger causes the trigger to pivot from the first end while moving the pin to cause the plunger to translate in the second direction as the pin moves through the slot.

9. The method of claim 1, wherein the biasing member is disposed within the interior space of the body.

10. The method of claim 1, wherein the inlet and the outlet each comprise a check valve.

* * * * *